US005365864A

United States Patent [19]

Switzer

[11] Patent Number: 5,365,864

[45] Date of Patent: Nov. 22, 1994

[54] LABORATORY SCALE INCINERATOR SIMULATION SYSTEM

[75] Inventor: Walter G. Switzer, San Antonio, Tex.

[73] Assignee: Southwest Research Institute, San Antonio, Tex.

[21] Appl. No.: 146,239

[22] Filed: Nov. 2, 1993

[51] Int. Cl.[5] ..... B09B 3/00

[52] U.S. Cl. ..... 110/235; 73/865.6; 110/185; 110/349

[58] Field of Search ..... 110/235, 185, 191, 193, 110/349; 73/865.6

[56] References Cited

U.S. PATENT DOCUMENTS 3,729,979 5/1973 Wilberg et al. .
3,881,430 5/1975 Katz .
4,330,298 5/1982 Hawn et al. .
4,398,475 8/1983 McKiel, Jr. .
4,404,461 9/1983 Sitek et al. .
4,429,645 2/1984 Burton .
4,565,561 1/1986 Gagne .
4,706,581 11/1987 Parkinson ..... 110/349
5,280,756 1/1994 Labbe ..... 110/191
5,287,817 2/1994 Lees, Jr. et al. ..... 110/193

*Primary Examiner*—Edward G. Favors
*Attorney, Agent, or Firm*—John L. Sigalos

[57] ABSTRACT

A laboratory scale incinerator simulation system having a primary combustion furnace and an associated secondary combustion furnace with both such combustion furnaces being adapted so that they can function with combustion chambers of various volumes to permit study of a wide variety of combustion parameters for determining optimum incineration conditions in commercial incinerators for both liquid and solid materials.

6 Claims, 2 Drawing Sheets

LABORATORY SCALE INCINERATOR SIMULATION SYSTEM

BACKGROUND OF THE INVENTION

The present invention relates to a laboratory scale incinerator simulation system enabling a variety of liquid and solid materials to be combusted under various process conditions in order to predict incineration conditions in large commercial incinerators and optimum incinerating conditions therefor based on measurements of combustion byproducts and exit gases.

At the present time there has been increased effort to incinerate wastes in an environmentally acceptable and economic manner. This ideally requires using the optimum conditions to incinerate and, hence, optimization of incinerating conditions for a wide variety of different liquid and solid waste materials, such as rate of waste introduction into the incinerator, primary incinerating conditions, secondary treatment conditions, and the like, and their interrelationship. Also, there is no accurate system to predict emissions from the combustion of new waste products or waste streams to determine optimum conditions for incineration thereof, or whether, in fact, incineration is a viable method for disposing of the same.

At the present time, other than actual studies in large scale commercial incineration equipment in which it is difficult to vary the incineration parameters and to study the incineration byproducts because of the size of the equipment and the large volumes of byproducts, there is no satisfactory small scale system permitting accurate studies to be conducted under careful controlled conditions.

There is no economic, rapid, and accurate system enabling one to vary all the parameters of an incinerator in order to determine optimum incinerating conditions in large commercial scale incinerators for any given waste, liquid or solid. Moreover, the available pilot or laboratory scale equipment utilized generally is suitable only for batch or for continuous operation and it is not heretofore been possible to operate the same incinerator simulator system in both modes. Also, some systems are not capable of modeling both the primary and secondary combustion processes under different combustion conditions. Some current systems for incinerator simulation also do not have a separate air controls for primary and secondary combustions zones thus not permitting accurate control over these important combustion variables. As a consequence, large amounts of particulates produced during the combustion have introduced analytical' differences in prior systems. Such carbonaceous particulates have been implicated in dioxin formation as they may provide a catalytic surface and/or organic material for dioxin formation.

Further, many of the current systems have but one size combustion zone and as a consequence it is not possible to provide more accurate control for various combustibles with respect to the gas residence times in the combustion zone or to vary the size sample to be treated in such zone.

SUMMARY OF THE INVENTION

The present invention overcomes the problems of the existing systems and provides a laboratory scale incinerator for accurately simulating incineration of liquid and solid waste materials in large, commercial size incinerators permitting laboratory study of wastes by accurate manipulation of fundamental incineration parameters including, but not limited to, waste feed rate, temperature in multiple heating zones, independent air supplies for the primary and secondary combustion zones, and gas phase residence time in the secondary zone.

Briefly stated, the present invention comprises a laboratory scale incinerator simulation system comprising, in combination:

(a) a primary combustion means having a primary combustion zone in the interior thereof with a primary combustion chamber extending therethrough, (b) a secondary combustion means having a secondary combustion zone in the interior thereof with a secondary combustion chamber extending therethrough, said secondary combustion chamber being in fluid-flow communication with said primary combustion chamber, (c) means operatively associated with said primary combustion means to introduce a specimen into said primary combustion chamber for incineration, (d) control means associated with each of said primary and secondary combustion chambers to vary the combustion conditions in each, and (e) sampling means associated with each of said primary and secondary combustion chambers for monitoring combustion conditions therein and resultant combustion byproducts;

(f) each of said primary and secondary combustion zones being adapted to receive and function with combustion chambers of different volumes.

DETAILED DESCRIPTION

Figure 1:
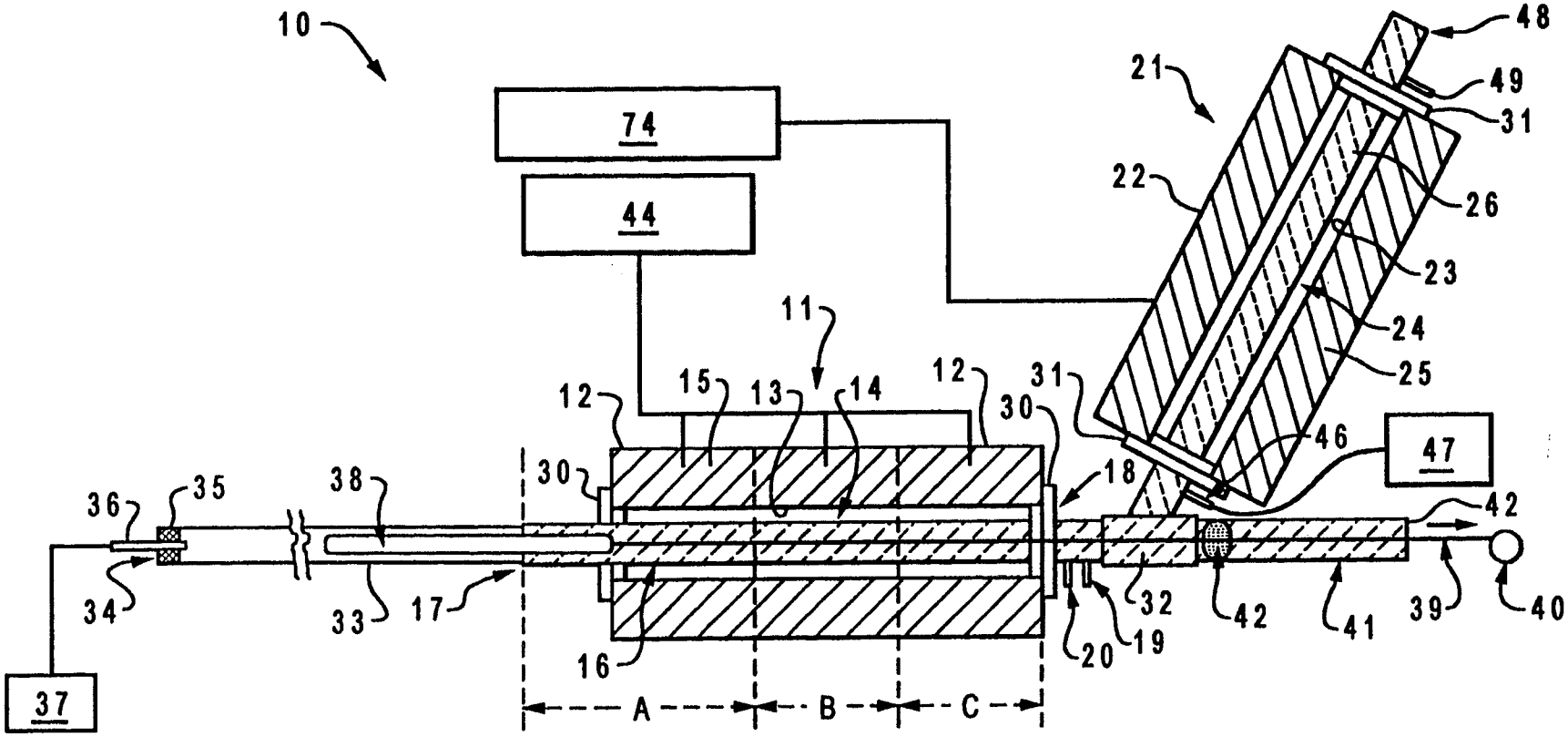
FIG. 1 is a schematic top plan sectional view of a laboratory scale incinerator simulation system in accord with the instant invention.

Referring to the drawings, it will be seen that the system 10 comprises two combustion means, first or primary combustion furnace 11 and secondary combustion furnace 21. Each of the furnaces 11 and 21, comprises an outer metal (preferably steel) shell 12 and 22, with conventional (preferably ceramic)insulation 15 and 25 between the respective shells defining primary and secondary combustion zones 14 and 24, respectively. Conventional electrical heating elements 13 and 23 are located with insulation 15 and 16 and act to heat combustion zones 14 and 24, respectively. Passing through combustion zones 14 and 24 are combustion chambers 16 and 26. Chambers 16 and 26 are preferably tubes made of a heat-resistant material, such as quartz or a ceramic, and extend beyond the respective outer shells 12 and 22. Each of combustion chambers 16 and 26 is removably attached to the respective furnace shells 12 and 22 by conventional removable tubing adapters 30 and 31 which also act to suspend chambers 16 and 26 so that they are evenly heated. The size of the combustion zones 14 and 24 is such that tubes 16 and 26 of varying diameters can be placed therein with suitably sized tube adapters 30 and 31 to permit control of sample capacity and combustion gas residence times.

Primary combustion chamber 16 is coupled to the secondary combustion chamber 26 furnace 21 by means of ceramic connector 32 to permit fluid flow communication of all combustion materials from the chamber 16 passes into chamber 26. Connector 32 is preferably heated by conventional electrical heating means wrapped thereabout (not shown) to maintain the temperature of the initial combustion products as they pass from chamber 16 to chamber 26.

Sample introduction tube 33 is sealingly connected to entrance 17 of combustion chamber 16 and has a sample introduction opening 34 provided with removable stopper 35 having primary combustion gas introduction means 36, a hollow rod, passing therethrough. Combustion gas is passed through rod 36 and tube 33 and into combustion chamber 16 from a conventional combustion gas metering device 37.

The liquid or solid to be combusted is placed in sample holding means 38, a quartz or ceramic boat, and the boat 38 placed in tube 33 and then into combustion chamber 16. It will be evident that stopper 35 is removed to position boat 38 in tube 33 and stopper 35 then repositioned in tube 33.

Wire 39 or other suitable tow device is associated with a take-up reel on motor 40 and attached to sample boat 38 so that sample boat 38 can be pulled at any desired regulated rate into and through primary combustion chamber 16 and into capture tube 41, tube 41 preferably being also made of quartz or a ceramic and being suitable sealed at its discharge end 42, with only a sealing opening for movement of wire 39 therethrough. In order to prevent escape of any of the combustion products from chamber 16, noncombustible movable blanket plug 42 is placed at the end of tube 41 through which wire 39 can pass in a sealing relationship without permitting escape of any of the combustion gases or solids therethrough. The length of sample boat 37 and its rate of passage through combustion zone 14, is such that the specimen being combusted is completely degraded prior to the time the front of sample boat 38 contacts plug 42. Moreover, as sample boat 38 is further moved it simply moves plug 42 in front of it while the remainder of capture tube 41 remains sealed. Alternatively, sample boat 38 can also be pushed through chamber 16 by conventional pushing means.

After any given combustion test is completed one can simply remove capture tube 41 from connector 32 to remove sample boat 38.

Provided adjacent exit 18 of chamber 16 are test ports 19 and 20 in which samples of the products of combustion, such as gases, semi-volatiles, and the like can be extracted for studies as well as temperature monitoring of the exhaust by means of a thermocouple or the like. It is evident that though two ports 19 and 20 are shown, a single port or greater number of ports can be used.

Combustion zone 14 is divided into three temperature control areas A, B, and C for the primary combustion, it being understood that a lesser or greater number of such can be utilized. A standard controller and power supply unit 44 is connected in the conventional manner to the furnace 11 for controlling the temperature in chamber 16 for each of areas A, B, and C. Initial area A can be a preheat zone where temperatures of up to 500° C. or higher can be provided and the primary combustion is carried out in areas B and C wherein the temperature can regulated in each up to 1,000° C. or higher as is desired for any test. Conventional controllers that can be used include PID types such as EUROTHERM or others such as BARBER-COLMAN devices and all can be utilized to closely regulate the temperatures in each of the zones of the furnace 11 as well as furnace 21 which also has a like controller 74 to regulate the temperature.

Furnace 21 contains auxiliary combustion gas input port 46 for introducing gas for secondary combustion to secondary combustion chamber 26 from metering device 47.

The system 10 can be operated in a horizontal or vertical position to enable experimentation to duplicate the positioning of the commercial incinerator being studied.

At the exhaust end 48 the secondary combustion chamber 26 there is shown test port 49 for sampling the temperature, gases, and the like. Additional ports can be used.

Figure 2:
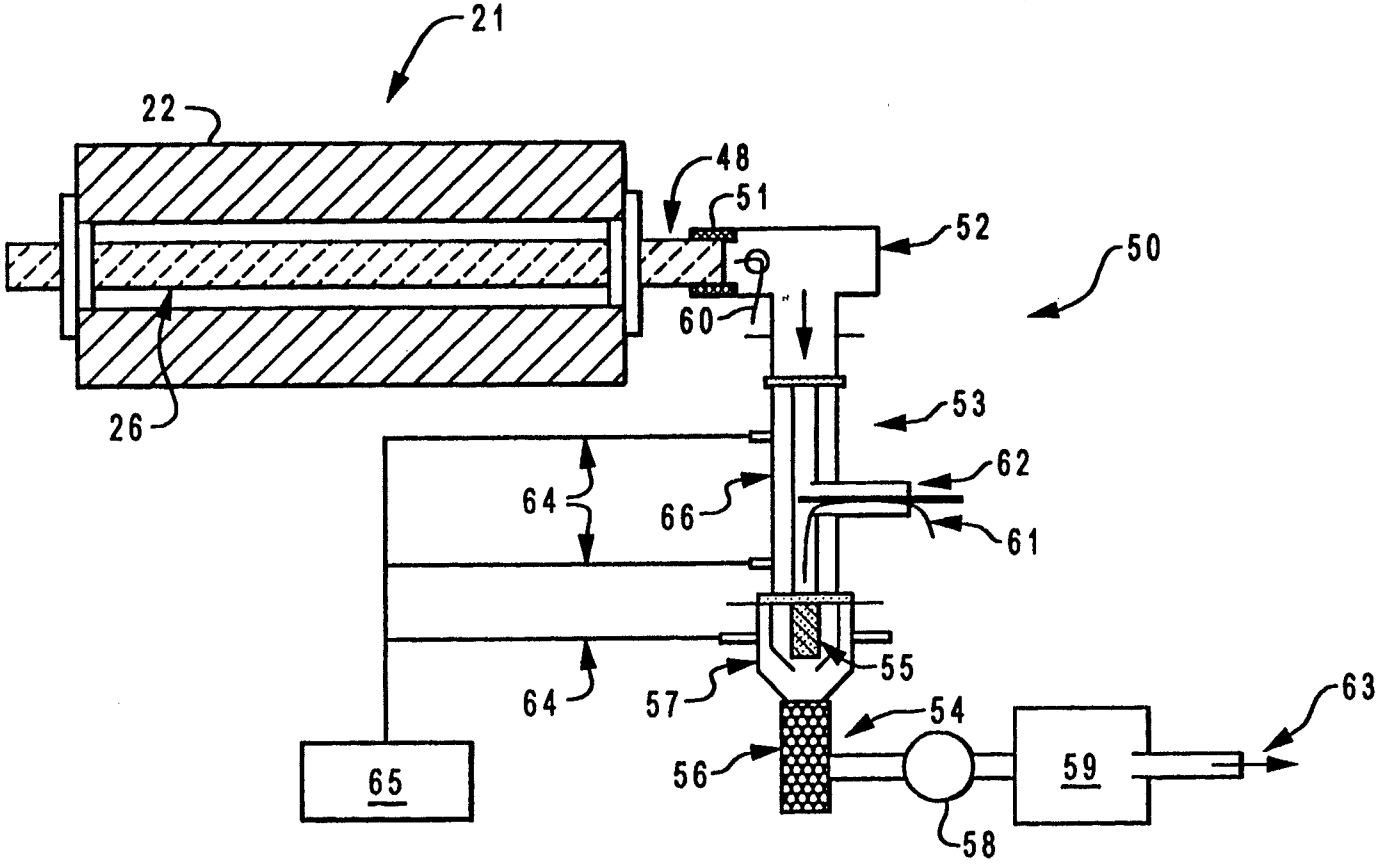
FIG. 2 is a schematic sectional view of the effluent laboratory scale incinerator simulation system processing unit that can be associated with the secondary combustion means of the instant invention.

FIG. 2 discloses incorporation with system 10 of an effluent processing unit 50 for intensive study of the materials leaving secondary combustion chamber 26 which is sealingly attached to exhaust 48 by means of a noncombustible blanket material 51. Unit 50 comprises a T-shaped coupler 52 connected at one end to exhaust 48 and at another end to a jacketed condensor 53 through which the exhaust pass into jacketed sampling module 54. Jacketed module 54 consists of filter means 55 for capturing semi-volatile materials, most suitably a polyurethane foam filter or other conventional trapping material. Module 54 is attached to condensor 53 by means of a conventional connector 57. In turn, sample module 54 is connected by conventional tubing to cleaner module 56 for capturing solids and acidic materials, and is preferably a cylinder containing charcoal or other absorbent material.

The exhaust fluids are pumped through the unit 50 by means of pump 58 and passed into dry gas meter 59 to measure the volume of the fluid before it is exhausted from the system. Provided in unit 50 are temperature measuring devices, such as thermocouples 60 and 61, located so as to enable measurement of the exhaust fluid temperature at the exhaust end 48 of chamber 26 as well as at condensor 53. A sample port 62 is also used in the condensor in order to be able to remove specimens therefrom and analyze the same.

It will be evident that only gas will leave the unit 50 through exit 63 and depending upon the nature of the combustion products; if it is completely harmless at that point it can be vented to the atmosphere and if not harmless, it can be placed into a suitable holding container.

Water lines 64 are connected to chilling bath 65 so as to circulate cold water through jacket 66 of condensor 53 and sampling module 54 to cool the fluid and condense any volatilized material therein prior to its passage through filter trapping means 55.

After a test run has been completed, unit 50 can be disassembled to remove filter 55 and cleanup module 56 so the material collected therein can be studied.

The operation of the system is largely evident from the description given, but typically the temperature that can be set in preheat area A ranges from 100° C. to 300° C. or higher, combustion area B can be set to a temperature of 550° C. to 1000° C., or higher and combustion area C can be set at temperatures of 550° C. to 1000° C. and higher. The secondary combustion chamber can be maintained at temperatures of 900° C. to 1200° C. The controllers noted for each furnace 11 and 21 are, as indicated, conventional devices which are microprocessor based with a solid state power module with each area or zone independently controlled. Combustion zones 14 and 24 are sized so as to enable insertion therethrough of combustion chambers 16 and 26 of different diameters; i.e., ranging from 25 to 150 millimeters in diameter.

Sample boat 38 is pulled through the furnace 11 and through the areas A, B, and C at any desired rate. The feed rate can be computer controlled by controlling motor 40 and can be fixed or variable during any given test run.

System flows are controlled by commercial high accuracy calibrated rotameters 37 and 47, or digital mass flow controllers. The system is capable of functioning at control levels or 0–350% or greater theoretical air to fuel ratio, and typically the ranges for both the primary and secondary combustion chambers 16 and 26 are 50% to 150% theoretical air. As noted, system 10 is equipped with a minimum of two supply air ports, the first for the primary combustion chamber 16 and the second for the secondary combustion chamber 26. The input air can be mixed via the rotameter described above and manifold system so that varying mixtures of nitrogen, oxygen or other gases can be supplied to the combustion zones.

The number of test ports, are noted, can be varied and as is conventional these can be monitored and controlled using conventional computer based data acquisition software which allows for maximum flexibility and data acquisition and system control. LABWINDOWS, an available software program, for example, can be utilized for the monitoring. Such system hardware consists of 486 based PC for data storage and analysis. Thus, it is possible to gather data which includes all operating parameters, such as set temperature and control settings, actual temperature histories, feed rate, gas sampling, and the like.

The instant system provides a highly accurate and versatile means for being able to determine in the laboratory or pilot plant the optimum incineration conditions for a wide variety of liquid and solid materials for any large scale commercial incinerator.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A laboratory scale incinerator simulation system comprising, in combination;

(a) a primary combustion means having a primary combustion zone in the interior thereof with a primary combustion chamber extending therethrough, (b) a secondary combustion means having a secondary combustion zone in the interior thereof with a secondary combustion chamber extending therethrough, said secondary combustion chamber being in fluid-flow communication with said primariy combustion chamber, (c) means operatively associated with said primary combustion means to introduce a specimen into said primary combustion chamber for incineration, (d) control means associated with each of said primary and secondary combustion chambers to vary the combustion conditions in each, and (e) sampling means associated with each of said primary and secondary combustion chambers for monitoring combustion conditions therein and resultant combustion byproducts;

(f) each of said primary and secondary combustion zones being adapted to receive and function with combustion chambers of different volumes.

2. The system of claim 1, wherein said primary combustion zone has a plurality of temperature control areas and each of said primary and secondary combustion chambers has an entrance and exit opening.

3. The system of claim 2, also including an effluent control unit in fluid-flow communication with the exit opening of said secondary combustion chamber, said unit containing means to remove solids and semivolatiles from effluent issuing from said exit opening.

4. The system of claim 3, wherein said effluent control unit also contains cooling means to condense vaporized materials present in said effluent.

5. The system of claim 1, including sample holding means attached to means for moving said sample holding means through said primary combustion zone at a desired rate of travel.

6. The system of claim 5, wherein said sample holding means is a boat and said means for moving said boat through said primary combustion zone comprises a wire attached to said boat and to a take-up reel operatively attached to a motor.

* * * * *